United States Patent [19]

Backus et al.

[11] Patent Number: 5,029,455

[45] Date of Patent: Jul. 9, 1991

[54] OIL RETURN SYSTEM FOR OIL SEPARATOR

[75] Inventors: Robert J. Backus, Dewitt; L. Thomas Lane, Manlius, both of N.Y.

[73] Assignee: Carrier Corporation, Syracuse, N.Y.

[21] Appl. No.: 517,869

[22] Filed: May 2, 1990

[51] Int. Cl.[5] ..... F25B 43/02

[52] U.S. Cl. ..... 62/470; 62/84

[58] Field of Search ..... 62/84, 468, 470, 473

[56] References Cited

U.S. PATENT DOCUMENTS

| | | | |
|---|---|---|---|
| 3,070,977 | 1/1963 | Kimmel et al. | 62/84 |
| 3,081,604 | 3/1963 | Namisniak et al. | 62/84 |
| 3,283,532 | 11/1966 | Kocher | 62/84 |
| 3,304,697 | 2/1967 | Ramsey | 62/473 |
| 4,310,338 | 1/1982 | Schumacher et al. | 62/84 |
| 4,472,949 | 9/1984 | Fujisawa et al. | 62/468 |
| 4,558,573 | 12/1985 | LaMonica | 62/84 |
| 4,800,736 | 1/1989 | Weber | 62/84 |

*Primary Examiner*—Ronald C. Capossela

[57] ABSTRACT

An oil separator is provided for separating oil from a refrigerant gas and returning the oil to a compressor. The separator includes a housing which has means associated therewith for conducting a mixture of refrigerant gas and oil into the housing and therein separating the oil from the gas. The separated oil is stored in a reservoir forming a part of the housing. A plurality of oil pickup devices are located within the oil reservoir. Each of the oil pickup devices has an oil pickup opening associated therewith. The oil pickup openings are located at different depths within the oil reservoir. The pickup devices are designed so that they are substantially more receptive to the flow of lubricating oil therethrough than to the flow of refrigerant gas. In one embodiment, the oil pickup devices are capillary tubes having their open ends located at different depths within the oil reservoir.

12 Claims, 2 Drawing Sheets

OIL RETURN SYSTEM FOR OIL SEPARATOR

BACKGROUND OF THE INVENTION

1. Field of the Invention

This invention relates to oil separation systems for use with refrigeration systems and more particularly to an apparatus for returning oil, separated from a mixture of refrigerant and lubricating oil, to the compressor of a refrigeration system.

2. Description of the Prior Art

Refrigeration systems, of the type used in transport refrigeration equipment, include, in the simplest form, a compressor, a condenser, an expansion device and an evaporator serially interconnected to form a closed refrigeration circulation path. Typically, such systems use a reciprocating type compressor which is lubricated by a lubricating oil which mixes with the refrigerant being compressed therein. In such transport refrigeration systems, the refrigerant R-12 has been used almost exclusively with satisfactory results. Since R-12 is completely miscible with the lubricating oils used in such systems, no problem has been experienced with the return of the oil to the compressor crank case during the wide range of operating conditions which a transport refrigeration system experiences. Also, since the oil and refrigerant remain mixed, even at low system temperatures, the thermodynamic characteristics of systems using completely miscible refrigerants are predictable. As a result, it has not been necessary to utilize oil separators in such systems. R-12, and many other completely miscible refrigerants, however, are in the family of refrigerants known as chlorofluorocarbons (CFCs). For many years CFCs have seen wide spread use in many different refrigeration applications. The reason for such popularity is that CFCs are stable and nonflammable, boil and condense in a useful temperature and pressure range, and were believed relatively inert and free of harmful side effects. Recently, there has been a growing scientific consensus that emissions of CFCs are depleting a layer of stratospheric ozone that protects the earths surface from the harmful effects of ultraviolet radiation. In response to this concern, international agreements have been entered into which require the parties thereto to reduce significantly their production and consumption of certain ozone—depleting CFCs and halons over the next decade. Further, federal and state bills, that seek to regulate use, manufacture, importation, and disposal of CFCs, are being considered.

A suitable substitute refrigerant for R-12 in low temperature applications, is R-22. R-22 is a member of a chemical family known as hydroclorofluorocarbons (HCFCs). It is believed that because of their hydrogen component, the HCFCs break down substantially in the lower atmosphere and their ozone depletion potential is substantially lower than that of R-12 and other CFC refrigerants.

R-22 is only partially miscible with lubricating oils. Below a certain temperature a partially miscible refrigerant-oil system may separate into two phases. One solution being particularly rich in oil and the other refrigerant rich. Such separation can result in detrimental heat transfer characteristics, as well as problems wherein the oil rich layer separates and collects in pockets or blind passages and thus the oil is not returned to the compressor sump. To alleviate this problem oil separators are frequently required in the discharge line to minimize oil circulation when partially miscible refrigerants are used in systems, particularly those involving low evaporator temperatures.

In such systems it is desirable to extract or separate the entrained oil from the refrigerant as quickly as possible after compression, to minimize the effects of the oil on other parts of the system. Furthermore, it is desirable to remove the entrained oil while the refrigerant is in the gaseous state since less separating effort is required, the refrigerant is easier to handle, and differential pressures are present in the gaseous state portion of the system for aiding the separation process. It is also desirable to provide a means for returning the separated oil back to the compressor sump.

A typical prior art oil separator comprises a housing having an inlet for the refrigerant/oil mixture, an outlet for the substantially oil free refrigerant gas and a return means for conducting the separated oil from the separator back to the compressor. Typically, a strainer is arranged about the inlet for the refrigerant/oil mixture and about the outlet for the refrigerant gas. The strainers are configured such that the one on the inlet catches oil on the inside and the one on the outlet catches oil on the outside. The strainers are typically separated by a baffle and allow separated oil to drip into the lower portion of the housing. In the lower portion, close to the bottom of the housing, a float assembly is positioned. The float assembly typically comprises a float ball attached to a lever arm for operating a needle valve within a valve body to open and close a valve seat and allow oil to be sent through a return line to the compressor oil sump. U.S. patents showing oil separating systems typical of that described hereinabove include U.S. Pat. No. 3,283,532 —Refrigerating Apparatus with Oil Separating Means to Eric J. Kocher and U.S. Pat. No. 4,310,338 —Replaceable Float Oil Separator to Earnest W. Shoemacher, et. al.

The oil separators of the type described above having mechanical float valves are not suitable for transport refrigeration applications because of the shock and vibration which such systems experience when they are on the road.

Other known types of oil return arrangements include the use of an electric solenoid in an oil return line. Such systems are not deemed suitable for a transport refrigeration application primarily because of the large number of operating cycles expected, coupled with, the requirement that such systems be extremely reliable, and capable of providing many years of trouble free operation.

U.S. Pat. No. 3,070,977 —Refrigeration System including Oil Separator and Muffler Unit and Oil Return Arrangement to C.J. Kimmel, et al. discloses the use of a standard orifice in an oil return line wherein the orifice is configured so that it passes oil freely, but restricts the passage of gas therethrough. The theory of the '977 patent is that when no oil is present in the region communicating with the entrance to the orifice and that region is occupied by a refrigerant gas, the difference in pressure across the orifice creates a "pressure shock" or "baffle shock" condition, so that no significant amount of gas flows through the orifice. In other words, the orifice itself acts as an open valve for the oil but acts as a substantially closed valve for the gas. Kimmel also employs a mechanical needle valve arrangement to control flow from the separator.

A capillary tube is another device which is selectively more receptive to the flow of a liquid than a vapor. Basically, liquid passes through a capillary much easier than a vapor, because the pressure drop experienced by vapor causes a decrease in density which in turn causes an increase in velocity to the point where sonic velocity (or "choked flow") is reached.

The use of a capillary in an oil return line of an oil separator is shown in U.S. Pat. No. 4,800,736 to Weber.

Transport refrigeration systems are subject to an extremely wide range of operating conditions and must be capable of operating reliably and maintaining a desired setpoint temperature over that wide range of conditions. As an example, a transport refrigeration system of the self contained, independent engine-driven type used for cooling trailers may be required to maintain a range of cargo temperatures from 55° F., for bananas, to −20° F. for a cargo of ice cream. The system further must be designed to have the capability of maintaining these temperatures when the ambient temperature ranges from −20° F. to 120° F.

It should be appreciated that during certain operating conditions of a transport refrigeration system, for example, during the initial pull down of the temperature of cargo which has been loaded at a temperature far greater than the desired setpoint, the amount of oil collected within the sump of the oil separator may vary and it is desirable to have an oil return system capable of providing variable rates of oil return from the separator to the compressor sump. It should also be appreciated that during the initial startup and operation of such systems, at the low range of the ambient temperatures which such a system may see, the viscosity of the lubricating oil will be such that return of oil to the compressor sump would be extremely difficult.

SUMMARY OF THE INVENTION

An object of the present invention is an improved oil return system for a refrigeration system.

A further object of the invention is an oil return system that has a minimum number of moving parts.

It is another object of the invention to provide an oil return system that has a variable rate of oil return.

It is another object of the invention to provide an oil return system that returns oil to a compressor effectively over a wide range of oil viscosities.

It is yet a further object of the present invention to provide an oil return system for a transport refrigeration system that is capable of returning oil to the compressor over the complete range of operating and startup conditions of the system.

It is a related object of the present invention to achieve these and other objects with a simple system which is reliable enough to provide years of trouble free operation in a transportation refrigeration system.

These and other objects of the present invention are achieved by an oil separator for separating oil from a refrigerant gas and returning the oil to a compressor. The separator includes a housing which has means associated therewith for conducting a mixture of refrigerant gas and oil into the housing and therein separating the oil from the gas. Means are provided for conducting the substantially oil free refrigerant from the housing. An oil reservoir at the lower end of the housing collects the separated oil and is configured so that the oil may be stored therein over a range of depths depending upon the operating condition of the refrigeration system. A plurality of oil pickup devices are located within the oil reservoir. Each of these devices has an oil pickup opening associated therewith. The oil pickup openings are located at several different depths within the oil reservoir. The pickup devices are designed so that they are substantially more receptive to the flow of lubricating oil therethrough than to the flow of refrigerating gas. Means are provided for collecting the oil from the plurality of oil pickup means and for conducting the collected oil from the housing. In the preferred embodiment, the oil pickup devices are a plurality of capillary tubes having their open ends located at different depths within the oil separator oil reservoir.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawing, and wherein;

DESCRIPTION OF THE PREFERRED EMBODIMENTS

Figure 1:
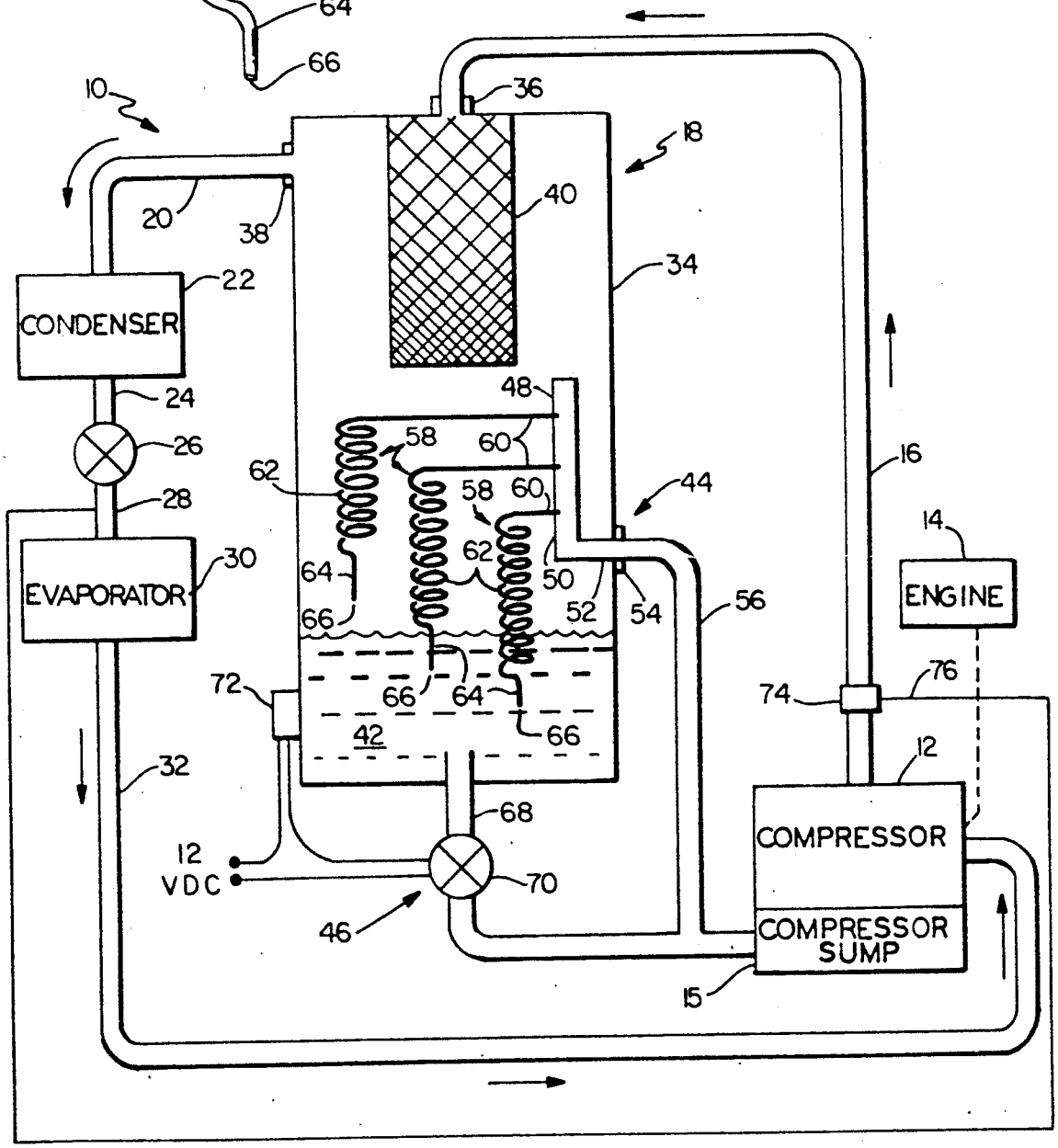
FIG. 1 is a schematic diagram of a refrigeration system utilizing an oil return system according to the principles of the present invention.

In FIG. 1, reference numeral 10 generally designates a compression refrigeration system of the type used in transport refrigeration applications. The system includes a compressor 12 which is adapted to be driven by an internal combustion engine 14. The compressor is preferably a reciprocating compressor, and a reservoir of oil is maintained in the crank case or sump 15 below the reciprocating piston. When the compressor 12 is driven by the engine 14, it compresses the refrigerant in the system, thereby raising its temperature and pressure and forces the refrigerant, along with a quantity of lubricating oil intermixed therewith, through a discharge line 16 to an oil separator 18 where the hot refrigerant gas and oil are separated from one another. Within the separator 18, the oil is collected and returned to the compressor sump 15 by way of the oil return system of the present invention which will be described in detail hereinbelow.

The hot, substantially oil free, gaseous refrigerant passes from the oil separator 18 through separator discharge line 20 to the condenser 22 where the gaseous refrigerant is forced into the condenser tubes (not illustrated). Heat is removed from the refrigerant in the condenser 22, and the refrigerant liquifies. The high temperature, high pressure, liquid refrigerant flows from the condenser via line 24 to an expansion device 26 such as a thermostatic expansion valve which reduces the pressure of the liquid refrigerant and meters the flow of liquid refrigerant to the evaporator 30 via refrigerant line 28. The reduction in pressure in the expansion device 26 is accompanied by a drop in temperature so that the low temperature, low pressure, liquid refrigerant supplied to the evaporator 30 is colder than the air circulated over the evaporator tubes (not illustrated).

Heat, is thus removed from the air circulated over the evaporator 30 and the resultant cold air is circulated, for example, throughout a box to maintain the cargo contained therein, at a desired temperature. The transfer of heat from the air to the low temperature refrigerant in the evaporator 30 causes the liquid refrigerant to vaporize. The resultant low temperature, low pressure, super heated gaseous refrigerant is returned through line 32 to the compressor 12.

The oil separator 18 comprises an oil separator housing 34. The housing 34 is provided with appropriate refrigerant line fittings for facilitating attachment of the compressor discharge line 16 and the oil separator gas discharge line 20, respectively identified by reference numeral 36 and 38 in the drawing. Attached to the upper end of the separator housing 34 and communicating with the connector 36 for the compressor discharge line 16 is an oil separation device 40 which is adapted to receive the mixture of hot refrigerant gas and oil discharged from the compressor and to effect the separation of the gas and oil received therein into separate components.

The specific configuration of the oil separation device 40 forms no part of the present invention and may be similar to those described in the description of the prior art. For example, a mesh screen or strainer could be used to receive and separate the mixture of gas and oil.

As described above, the hot refrigerant gas thus separated, passes from the oil separator 18 through the gas discharge line 20. The separated oil forms droplets and falls under the influence of gravity to the bottom of the separator housing 34 where it is collected in an oil reservoir 42 forming the lower end of the housing 34. The oil reservoir 42 is configured such that the level of oil stored therein may vary over a predetermined range of depths. The variation in depths depends upon the operating conditions of the system.

Figure 2:
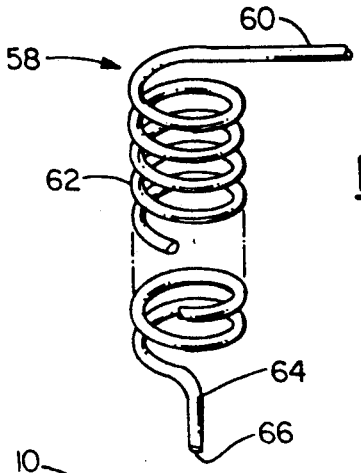
FIG. 2 is an enlarged detailed showing of a capillary tube of the type used in the system shown in FIG. 1.
Figure 3:
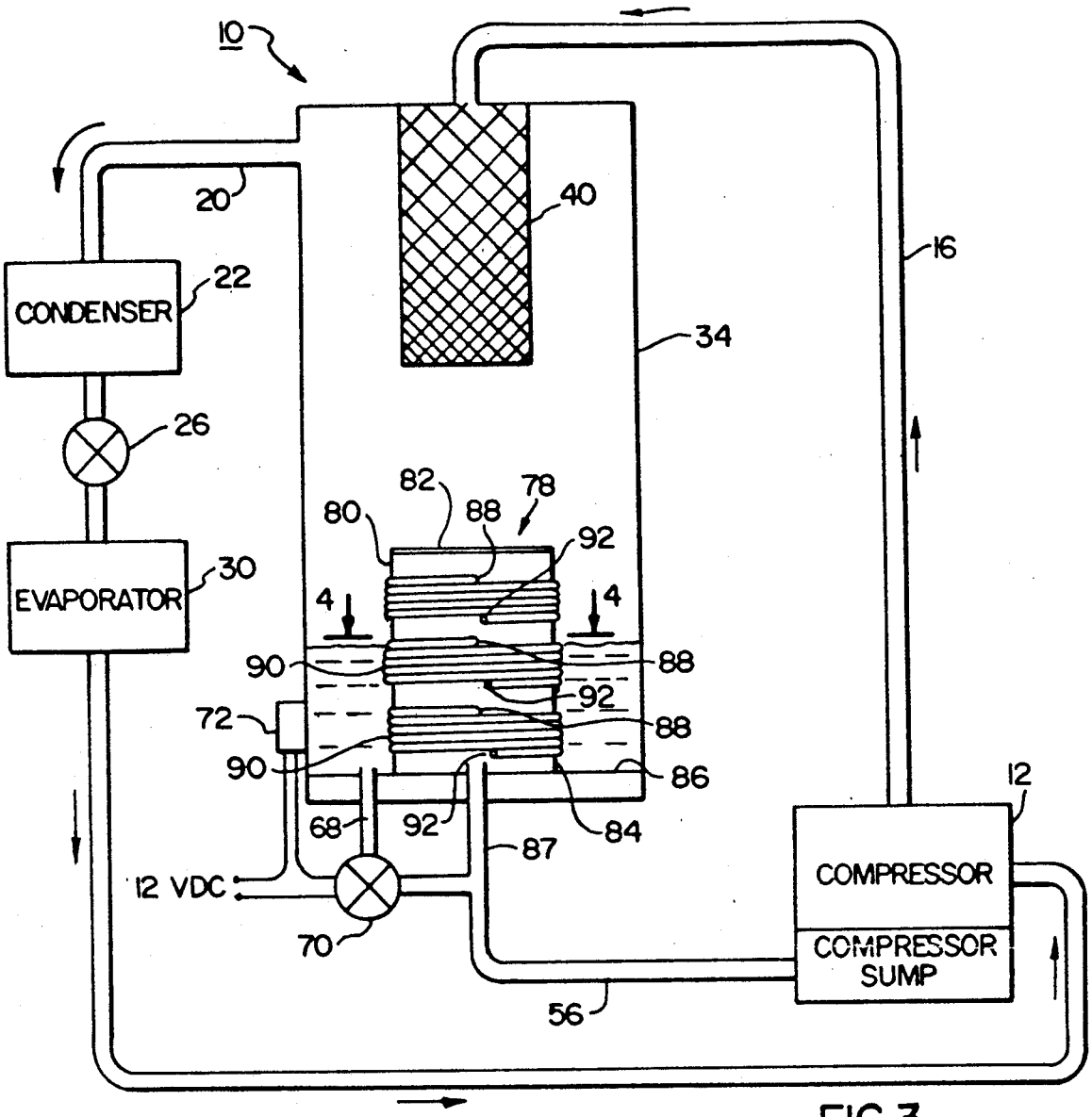
FIG. 3 is a showing of a preferred embodiment of the oil return system of the present invention.
Figure 4:
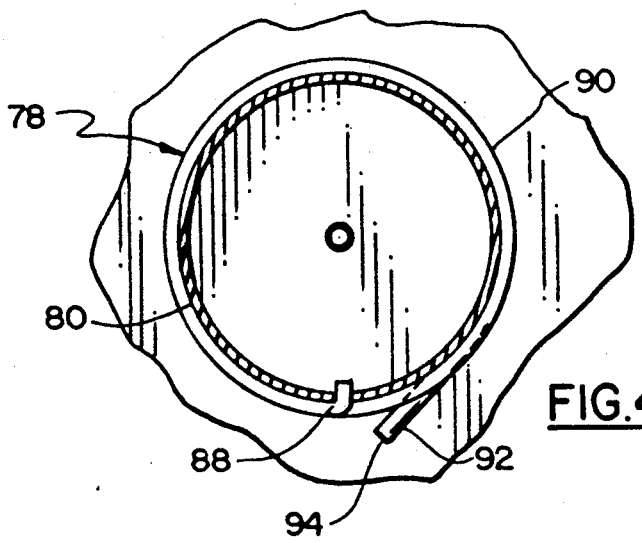
FIG. 4 is a sectional view taken along the line 4—4 of FIG. 3.

With reference now to FIGS. 1 and 2, reference numeral 44 designates a first oil return system which will be referred to as the normal operation oil return system. The normal oil return system shown in these figures is a simplified showing of a system according to the principles of the invention. This system will be described first to facilitate a thorough understanding of the invention. A preferred apparatus for making practical use of the principles of the invention is shown in FIGS. 3 and 4 and will be described below.

The normal oil return system 44 comprises a vertically extending oil collection manifold 48 located within the separator housing 34. The lower end 50 of the manifold 48 terminates in a right angled bend 52 which extends through the wall of the separator housing 34 and terminates with a connecter 54 which is adapted to be coupled to an oil return line 56 which in turn is in fluid communication with the compressor sump 15.

Communicating with the vertically extending oil collection manifold 48, within the separator housing 34, are a plurality of capillary tubes 58 which serve as oil pickup devices. Each of the capillary tubes 58 functions to pick up oil from the reservoir 42 and conducts the oil picked up thereby to the manifold 48. From the manifold the collected oil is returned, via the oil return line 56, to the compressor sump 15. In the embodiment shown, as best seen in FIG. 2, each of the capillaries 58 includes a horizontally extending section 60 in fluid communication with the manifold 48, a substantially vertically extending coiled section 62, and, a vertically extending end 64 having an open end 66 which defines the oil pickup opening of the capillary. The open ends 66 forming the oil pickup openings are positioned at different levels within the separator oil reservoir 42.

To repeat the principal described above in the background of the invention, a liquid passes through a capillary tube much more readily than a vapor.

With this principal in mind, it will be appreciated that each of the capillaries 58 will provide an effective means for picking up oil from the reservoir 42 and returning that oil from the separator to the compressor sump 15, when the respective inlet openings 66 of the capillaries are immersed in refrigerant oil.

It further will be appreciated that when the inlet opening 66 of any of the capillaries is not immersed in oil, it is exposed to the refrigerant gas which occupies the remaining volume of the oil separator housing 34. Because, however, of the above noted behavior of capillary tubes, the tube ends 66 exposed to refrigerant gas will not freely receive gas therein.

The arrangement described above, and as shown in the drawings will accordingly provide a variable rate of oil return from the oil separator 18 to the compressor sump 15. Stated in another manner, as the level of refrigerant oil within the oil reservoir 42 rises, the inlet openings 66 of additional capillaries 58 will become immersed in oil. After they become immersed in oil, these additional capillaries will begin to operate to return oil to the compressor sump 15, thus increasing the return capacity of the system.

It should be appreciated that, while three (3) capillaries 58 are shown in the illustrated embodiment, any number of capillaries may be used according to the principle of the invention. Further, one or more capillaries may have their ends terminating at the same depth within the oil reservoir 42 depending upon the desired oil return capacity which the designer feels is necessary for a particular system.

Reference numeral 46 identifies a second oil return system which will be referred to as the low temperature, high viscosity oil return system.

The capillary tube oil return system 44, described above, functions well during normal operating conditions, when the oil within the reservoir 42 is warm. However, on cold startups, especially in cold ambient temperatures, the oil viscosity is much too high to flow through the capillaries. Under these conditions, oil return is handled by the low temperature, high viscosity, oil return system 46. This system comprises an oil return line 68 which passes through the bottom of the separator housing 34 into fluid communication with the oil reservoir 42. The oil return line 68 communicates with the oil return line 56 of the normal operation oil return system 44 and thereby joins the oil line which communicates with the compressor sump 15.

A normally closed solenoid valve 70, which is controlled by a thermostat 72, which senses oil temperature is disposed within the oil return line 68. The thermostat 72 is located on the outside of the housing 34 and is designed to interrupt a 12v DC power supply 75 when the sensed temperature rises above a predetermined level.

Accordingly, on startup, or when the oil in the reservoir is too cold to flow through the capillaries 58, the valve 70 will be open to allow oil to freely flow to the compressor sump 15. When the oil warms up to the point where viscosity is low enough to flow through the capillaries 58, the thermostat 72 will interrupt power to the valve 70. The normally closed valve will then close and remain closed during normal system operation. This arrangement results in a minimal amount of cycling of the valve, thus preventing premature failure due to excessive cycling.

Referring now to FIGS. 3 and 4, a preferred embodiment of the capillary tube and oil collection manifold arrangement is shown. In this embodiment, the refrigeration system components, the oil separator housing 34, the oil separator structure 40, the refrigerant intake line 16 and the hot gas discharge line 20 are substantially as described and shown above in connection with the FIG. 1 embodiment.

The capillary oil pickup system illustrated in FIGS. 3 and 4 comprises a cylindrical oil pickup manifold 78 which comprises a cylindrical outer wall 80 and a circular steel cap 82. The manifold 78 is located in the separator housing 34 and the lower end 84 thereof is welded to the bottom 86 of the separator housing 34. An oil return line 87 communicates the interior of the cylindrical manifold 78 with the return line 56 to the compressor sump. As in the embodiment of FIGS. 1 and 2, a low temperature, high viscosity oil return system 46 comprising oil return line 68 and normally closed solenoid valve 70, controlled by a thermostat 73 is provided. The system 46 is substantially the same as the previously described embodiment, with the exception that the return line 68 is offset from the center of the separator housing.

The cylindrical manifold 78 is provided with a plurality of small openings 88 at several locations along the height thereof. In the embodiment shown, three of such openings 88 are shown. Associated with each of the openings 88 is a capillary tube oil pickup device 90. Each of the capillary tube pickup devices 90 comprises one end which is brazed or soldered to a respective opening 88 in the cylindrical manifold 78. From its attachment point to the cylindrical manifold, each of the capillary tubes is wound about the cylindrical manifold 78 to form a helically wound coil therearound. The other ends 92 of each of the capillary tubes, whose open ends 94 define the oil pickup openings, are bent outwardly from the helical winding upon the cylindrical manifold 78, as best shown in FIG. 4.

The above described capillary tube oil pickup arrangement functions in exactly the same manner as the oil return system described in connection with FIG. 1. Specifically, as each of the open ends 94 of the respective capillary tubes 90 become immersed in oil it begins to conduct oil collected within the reservoir 42, through the capillary tube 90, and thence into the interior of the cylindrical manifold 78, and from there through the return line 56 to the compressor sump 15. As with the previously described system, the capillary tubes 90 will selectively exclude refrigerant gas from the oil return system when the respective ends of a particular capillary tube are not immersed in refrigerant oil.

What is claimed is:

1. An oil separator for separating oil from a refrigerant gas and returning the oil to a compressor comprising:

a housing;

means associated with said housing for conducting refrigerant gas and oil into said housing and separating the oil from the gas;

means for conducting substantially oil-free refrigerant from said housing;

an oil reservoir at the lower end of said housing for collecting the separated oil therein, said reservoir being configured to store oil over a range of depths therein;

a plurality of oil pickup devices located within said oil reservoir, each of said devices having an oil pickup opening therein, said oil pickup openings being located at predetermined depths within said reservoir, at least one of said depths being different from the other depths, said pickup devices being substantially more receptive to the flow of oil therethrough than to the flow of gas; and means for collecting the oil from said plurality of oil pickup means and for conducting the collected oil from said housing.

2. The apparatus of claim 1, wherein said oil pickup devices are capillary tubes.

3. The apparatus of claim 2, wherein said oil pickup openings are the open ends of said capillary tubes and each of said open ends is located at a different depth within said reservoir.

4. The apparatus of claim 3 wherein said means for collecting comprises a closed, vertically extending , cylindrical collection manifold located within said reservoir, said manifold having an opening at the lower end thereof communicating the interior thereof to the exterior of said housing; each of said capillary tubes being wound around said manifold, and, the other ends of said capillary tubes communicating with the interior of said collection manifold.

5. A refrigeration system including a compressor having an oil carrying sump;

an oil separator connected to the high pressure side of said compressor to effect the separation of oil from refrigerant;

an oil reservoir associated with said oil separator for collecting the separated oil;

a first oil conducting path between said reservoir and said sump, said first path being capable of allowing sufficient oil flow therethrough for acceptable system operation only when the viscosity of the oil is below a predetermined value;

a second oil conducting path between said reservoir and said sump, said second path allowing sufficient oil flow theretnrough for acceptable system operation at all oil viscosities.

6. The apparatus of claim 5, including means for stopping the flow of oil along said second path when the oil viscosity drops below said predetermined value

7. The apparatus of claim 6, wherein said means for stopping comprises a valve.

8. The apparatus of claim 7 including means for sensing the temperature of oil in said reservoir and for causing said valve to close when the oil temperature reaches the temperature which corresponds to said predetermined value of the oil viscosity.

9. The apparatus of claim 8, wherein said valve is a solenoid actuated valve and wherein said means for sensing and closing includes means for selectively energizing and de-energizing said solenoid valve.

10. The apparatus of claim 9, wherein said valve is biased to a closed position when it is not electrically energized and wherein energizing said valve results in opening of said valve.

11. The apparatus of claim 5, wherein said first oil conducting path comprises at least one capillary tube located within said reservoir, and, said capillary tube having an open end thereof positioned to be immersed in the oil collected within said reservoir.

12. The apparatus of claim 11, comprising a plurality of capillary tubes located within said reservoir, said open ends of said capillary tubes being located at different elevations within said reservoir.

* * * * *